US005762589A

United States Patent [19]

Parker, Jr.

[11] Patent Number: 5,762,589

[45] Date of Patent: Jun. 9, 1998

[54] BULBOCAVERNOSUS MUSCLE EXERCISING APPARATUS

[76] Inventor: Clarence Parker, Jr., 15433 Sorrento, Detroit, Mich. 48227

[21] Appl. No.: 584,514

[22] Filed: Jan. 11, 1996

[51] Int. Cl.[6] ..... A63B 21/002

[52] U.S. Cl. ..... 482/91; 482/131; 482/148; 128/845; 600/38; 601/23

[58] Field of Search ..... 482/91, 139, 140, 482/142, 148, 131, 23, 25; 600/38, 39, 41, 40; 128/845; 601/23, 45

[56] References Cited

U.S. PATENT DOCUMENTS

| | | | |
|---|---|---|---|
| D. 344,341 | 2/1994 | Smith | D24/200 |
| 2,255,464 | 9/1941 | Hall, Jr. | 128/845 |
| 3,080,865 | 3/1963 | Vincent | 128/DIG. 25 |
| 4,048,985 | 9/1977 | Sasse | 128/778 |
| 4,201,202 | 5/1980 | Finney et al. . | |
| 4,749,186 | 6/1988 | Harding-Randle | 482/124 |
| 4,840,370 | 6/1989 | Biddlecombe | 482/49 |
| 5,007,633 | 4/1991 | Lemire | 482/142 |
| 5,027,800 | 7/1991 | Rowland . | |
| 5,050,875 | 9/1991 | Lewkovich | 482/49 |
| 5,127,422 | 7/1992 | Colon | 128/845 |
| 5,439,007 | 8/1995 | Fischer | 128/842 |
| 5,452,728 | 9/1995 | Iams | 128/845 |
| 5,472,399 | 12/1995 | Szekely | 600/38 |

OTHER PUBLICATIONS

Jewelewicz, Raphael, Male Reproductive Anatomy, *The Columbia Univ. Coll. of Physicians & Surgeons Complete Home Medical Guide*, Ed. 2, pp. 158–159, 1989.

Roman, Mark, The Good Sex Workout: Great Lovers Aren't Born, They're Trained. A Workout Plan to Power Up Your Sex Life., *Men's Health*, v9, n7, pp. 70–75, Sep. 1994.

Kramer, Anna, Naked Truths: Five Ways Women Mislead Men About Sex–and How to Bust the Myths (includes exercises that enchance lovemaking), *Men's Health*, v9, n9, pp. 92–99, Nov. 1994.

*Primary Examiner*—Richard J. Apley
*Assistant Examiner*—Victor K. Hwang
*Attorney, Agent, or Firm*—Brooks & Kushman P.C.

[57] ABSTRACT

An apparatus for strengthening and toning a person's bulbocavernosus muscle is disclosed which includes a base and a contact portion having a convex elongated upper surface which is fixed relative to the base. The base and contact portion of the device are connected together by hinged connection with a prop moveable between a storage position and an exercise position in which the contact portion is raised above the base. The sides of the contact portion are contoured to reduce the width of the contact portion at the inward end thereof. The contact portion is preferably covered by a layer of padding material on its upper surface. The method of the present invention is an isometric exercise method wherein a convex member is placed on a horizontal supporting surface. The exercise method requires sitting on the supporting surface with the bulbocavernosus muscle resting on the convex member. The bulbocavernosus muscle is contracted and relaxed repetitively to strengthen and tone a person's bulbocavernosus muscle.

2 Claims, 2 Drawing Sheets

BULBOCAVERNOSUS MUSCLE EXERCISING APPARATUS

TECHNICAL FIELD

The invention generally relates to an isometric exercise device and method of exercising the bulbocavernosus muscle.

BACKGROUND ART

The bulbocavernosus muscle in the male surrounds and compresses the bulb of the penis and the bulbar portion of the urethra. It is believed that exercising the bulbocavernosus muscle can lead to increased male potency. Strengthening tendons and connective tissue through exercise can also minimize or reduce the chance of groin injury.

Prior art approaches to male potency problems includes surgical implants and cardiovascular medication. One example of a penile prothesis is disclosed in U.S. Pat. No. 4,201,202. A disadvantage of this type of procedure is expense and the necessity for surgical procedures that have inherent risks associated with them.

Another approach to male potency problems is disclosed in U.S. Pat. No. 5,027,800, wherein an erection truss is temporarily worn by a man to help him maintain an erection. A disadvantage of this approach is that it requires the application of the truss prior to sexual intercourse making it cumbersome and inconvenient.

The above problems and shortcomings of the prior art are addressed by the present invention which is summarized below.

SUMMARY OF THE INVENTION

It is an object of the present invention to provide a method and apparatus for improving male potency through exercising the bulbocavernosus muscle. By strengthening the bulbocavernosus muscle and tendons and connective tissue associated therewith, it is believed that in many instances the need for surgical implants and medications or trusses can be eliminated.

It is another object of the invention to provide a device for exercising the bulbocavernosus muscle which is portable and can be used in conjunction with any seating surface.

It is a further object of the invention to provide an exercise device and method wherein groin area injuries can be minimized by strengthening the tendons, connective tissue and muscles in the groin area.

An important objective of the invention is to provide an exercise apparatus and method wherein the vascular system within the penis is improved.

It is another object of the invention to provide an exercise method and apparatus that generally improves the physical characteristics of the penis.

According to the invention, isometric exercise apparatus for strengthening and toning a person's bulbocavernosus muscle is disclosed which includes a base and a contact portion having a convex, elongated upper surface. The contact portion is connected to the base of the exercise apparatus and is fixed relative to the base.

According to another aspect of the invention, the contact portion and base are hingedly connected to each other on one end and a prop is disposed between the contact portion and the base on the distal end of the apparatus. According to another aspect of the invention, the contact portion has contoured sides which reduce the width of the contact portion at an inward end of the apparatus. The contact portion of the device preferably includes a layer of padding material disposed on the upper surface for the comfort of the user.

The method of the invention is an isometric method of exercising a person's bulbocavernosus muscle comprising the steps of placing a convex member on a horizontal supporting surface. The user sits on the supporting surface with the bulbocavernosus muscle resting on the convex member. The user then contracts and relaxes the bulbocavernosus muscle repeatedly while bearing down upon the convex member.

According to another aspect of the invention, the method includes placing one testicle on each side of the convex member prior to the contracting and relaxing steps of the method.

These and other objects and advantages of the present invention will be better understood in view of the attached drawings and in light of the following detailed description of the invention.

DESCRIPTION OF THE BEST MODE

Figure 1:
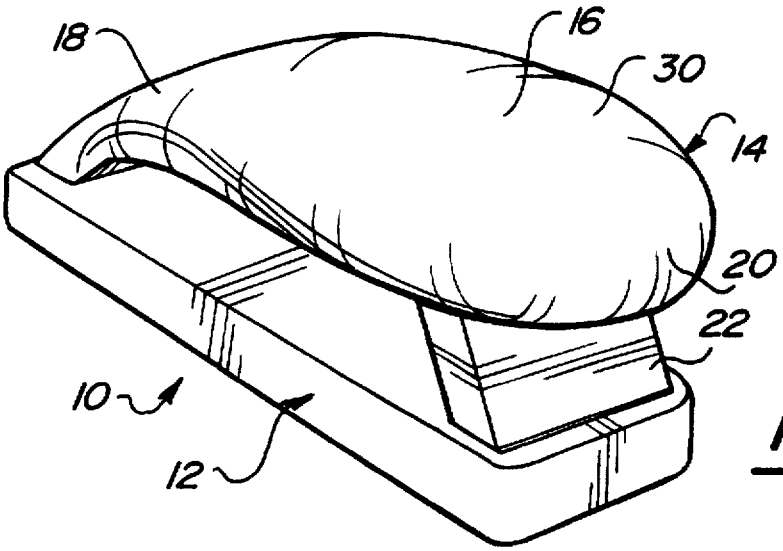
FIG. 1 is a perspective view of the isometric exercise apparatus of the present invention.
Figure 2:
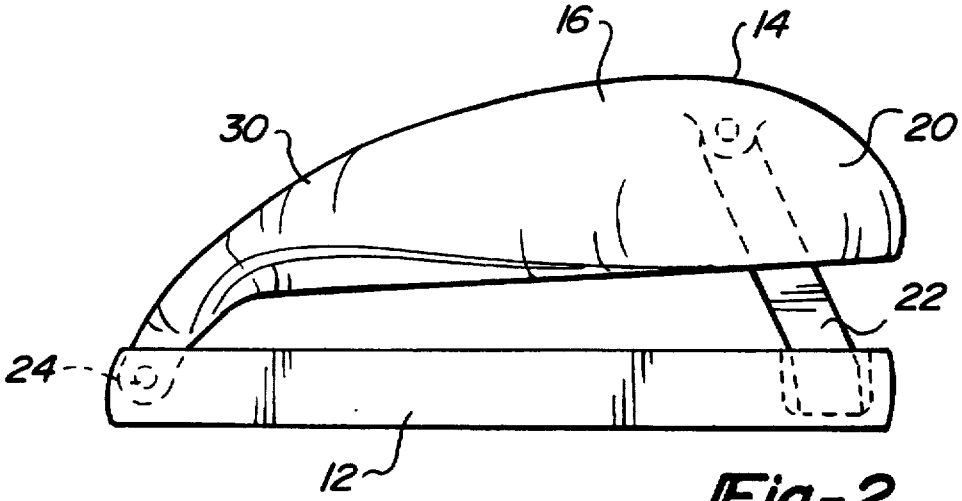
FIG. 2 is a side elevation view of the isometric exercise apparatus of the present invention.
Figure 3:
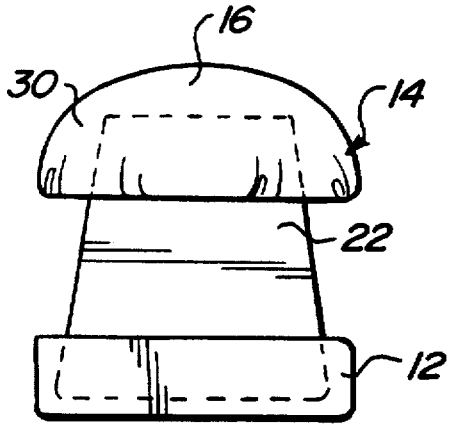
FIG. 3 is a front elevation view of the isometric exercise apparatus of the present invention.
Figure 4:
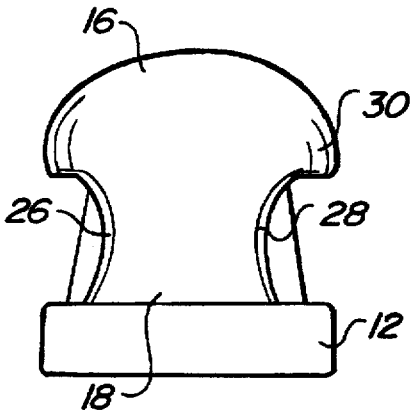
FIG. 4 is a rear elevation view of the isometric exercise apparatus of the present invention.

Referring now to FIGS. 1 through 4, the bulbocavernosus exercise apparatus 10 is shown. The apparatus 10 includes a base 12 and a contoured portion 14 which is attached to the base 12. The contoured portion 14 includes an upper surface 16 which is generally convex in shape, but elongated. The contoured portion 14 extends from an inner end 18 of the device to a distal end 20.

The contoured portion 14 is supported above the base 12 by means of a prop 22. The prop 22 is pivotably connected to the contoured portion 14 and is moveable between a storage position and an extended exercise position. The contoured portion 14 and base 12 are preferably connected by a hinge 24.

The contoured portion 14 also includes left and right side walls 26 and 28, respectively, which are tapered to reduce the width of the contoured portion 14 as it approaches the inner end 18. The entire contoured portion 14 is preferably covered by suitable padding material 30 for cushioning the apparatus for the comfort of a user.

Figure 5:
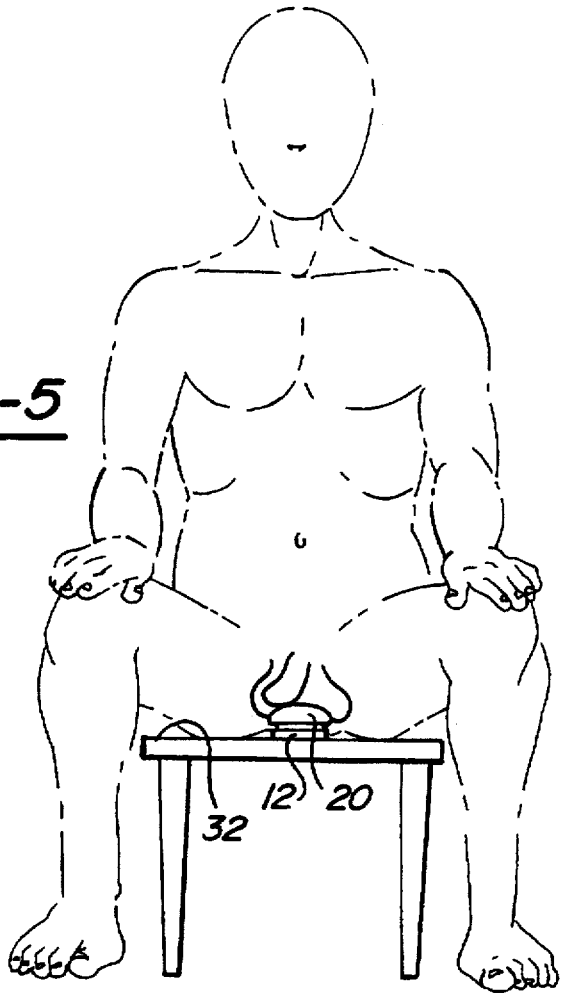
FIG. 5 is a front elevation view of a person shown in phantom lines using the isometric exercise apparatus of the present invention.
Figure 6:
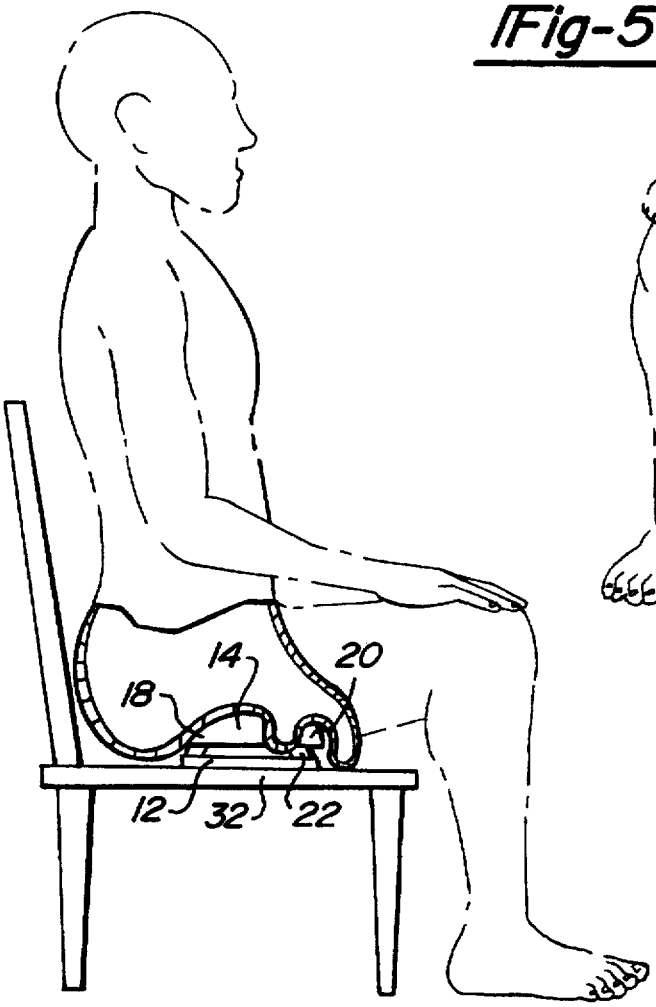
FIG. 6 is a partially cut-a-way side elevation view of a person shown in phantom lines using the isometric exercise apparatus of the present invention.

Referring now to FIGS. 5 and 6, the bulbocavernosus exercise apparatus 10 is shown in use. The apparatus 10 is placed on a supporting surface 32 such as a chair, vehicle seat or exercise bench. The user sits on the supporting surface 32 with the inner end 18 adjacent the user's anus and with the upper surface 16 engaged by the bulbocavernosus muscle. The user's testicles are preferably placed on the side of the contoured portion 14.

In operation, the exercise apparatus 10 is used by first placing it on a supporting surface 32. It should be understood that the exercise device could be incorporated in a bench or seat of another type of seating surface. The user then sits on the supporting surface with his bulbocavernosus muscle resting on the upper surface 16 of the contoured portion 14. The user then places one testicle on each side of the convex member and then contracts the bulbocavernosus muscle while bearing down upon the convex member. The bulbocavernosus muscle is then relaxed with the contracting and relaxing steps being repeated for a desired number of repetitions. The exercise can be repeated until a burning sensation is felt in the bulbocavernosus muscle. The upper torso of the user presses downwardly on the apparatus while the user contracts his bulbocavernosus muscle. The resistance provided by the apparatus 10 can be adjusted by moving the apparatus 10 toward or away from the rectum area. The closer the device is placed to the rectum, the greater resistance can be obtained by bearing down upon the apparatus 10.

It is believed that with a carefully planned program for usage of the apparatus, one can improve male potency and generally strengthen the groin region. Strengthening the bulbocavernosus muscle can also enlarge the apparent size of a person's penis in both the flaccid and erect states by lessening the tendency of the penis to draw up into the pelvis cavity.

The above description of the best mode of practicing the invention is intended to be illustrative and should not be read in a limiting sense. The broad scope of the present invention should be construed based on the following claims.

What is claimed is:

1. An isometric exercise apparatus for strengthening and toning a person's, bulbocavernosus muscle, the person seated on a support surface, the apparatus comprising:

a base sized and configured to be placed between the persons legs and between the persons bulbocavernosus muscle and the support surface, said base having an inner end and a distal end;

a contact portion connected to the inner end of said base, said contact portion having an elongated upper surface sized and configured to be placed between the person's legs and to be engaged with the person's bulbocavernosus muscle, wherein the upper surface is convex between a distal end and an inner end of said contact portion; and a rigid prop connected to the distal end of said contact portion and said base so that the contact portion is spaced above the base on its distal end, said prop being disposed between said contact portion and said base to fix the spacing between said contact portion and said base, wherein said prop supports said base in an exercise configuration such that the distal end of said contact portion is raised above the distal end of said base, and wherein the seated person may place the apparatus in the exercise configuration between their legs with the upper surface of the contact portion in engagement with their bulbocavernosus muscle and the base supported by the support surface so that the upper surface of the contact portion provides isometric resistance when the person contracts their bulbocavernosus muscle while bearing down upon the upper surface.

2. An isometric exercise apparatus for strengthening and toning a person's bulbocavernosue muscle, the person seated on a support surface, the apparatus comprising:

a base sized and configured to be placed between the person's legs and between the person's bulbocavernosus muscle and the support surface, said base having an inner end and a distal end;

a contact portion hingedly connected to the inner end of said base, said contact portion having an elongated upper surface sized and configured to be placed between the person's legs and engaged by the person's bulbocavernosus muscle, wherein the upper surface is convex between a distal end and an inner end of said contact portion; and a rigid prop hingedly connected to the distal end of said contact portion, said prop disposed between said contact portion and said base to selectively fix the height between said contact portion and said base, wherein the hinged connection of said prop permits said prop to be moved between a storage configuration such that said base and said contact portion are adjacent one another and an exercise configuration such that the distal end of said contact portion is raised above the distal end of said base and wherein the seated person may place the apparatus in the exercise configuration between their legs with the upper surface of the contact portion in engagement with their bulbocavernosus muscle and the base supported by the support surface so that the upper surface of the contact portion provides isometric resistance when the person contracts their bulbocavernosus muscle while bearing down upon the upper surface

* * * * *